US011255629B2

(12) United States Patent
D'Acquisto

(10) Patent No.: US 11,255,629 B2
(45) Date of Patent: Feb. 22, 2022

(54) ARCHERY BOW CONCEALMENT ACCESSORY

(71) Applicant: Andrae D'Acquisto, Bellevue, IA (US)

(72) Inventor: Andrae D'Acquisto, Bellevue, IA (US)

( * ) Notice: Subject to any disclaimer, the term of this patent is extended or adjusted under 35 U.S.C. 154(b) by 0 days.

(21) Appl. No.: 16/602,956

(22) Filed: Jan. 4, 2020

(65) Prior Publication Data

US 2020/0217610 A1 Jul. 9, 2020

Related U.S. Application Data

(60) Provisional application No. 62/917,935, filed on Jan. 8, 2019.

(51) Int. Cl.
*F41B 5/20* (2006.01)
*F41B 5/14* (2006.01)

(52) U.S. Cl.
CPC ..... *F41B 5/1403* (2013.01); *F41B 5/1426* (2013.01); *F41B 5/1496* (2013.01)

(58) Field of Classification Search
CPC .. F41B 5/00; F41B 5/14; F41B 5/1496; F41B 5/1426
See application file for complete search history.

(56) References Cited

U.S. PATENT DOCUMENTS 3,179,102 A * 4/1965 Peckham ..... F41B 5/1496 124/23.1
4,056,648 A * 11/1977 Richardson ..... B44C 1/1756 428/138
4,769,265 A * 9/1988 Coburn, Jr. ..... B44C 1/105 428/323
4,876,817 A * 10/1989 Hill ..... A01M 31/00 43/1
4,974,575 A * 12/1990 Mitchell ..... F41B 5/1496 124/23.1
5,021,275 A * 6/1991 Kim ..... B44C 1/105 428/202
5,055,343 A * 10/1991 Murphy ..... B44F 7/00 428/209
5,127,180 A * 7/1992 Norton ..... A01M 31/00 135/901
5,427,085 A * 6/1995 Martin ..... F41B 5/1496 124/1
5,595,168 A * 1/1997 Martin ..... F41B 5/1426 124/88
6,382,201 B1 * 5/2002 McPherson ..... F41B 5/0005 124/23.1
6,712,058 B2 * 3/2004 Porter ..... F41B 5/1496 124/86
8,372,478 B1 * 2/2013 Harris ..... B05D 5/066 427/197
8,931,464 B2 * 1/2015 Jackson ..... F41B 5/1403 124/23.1

* cited by examiner

*Primary Examiner* — John A Ricci

(57) ABSTRACT

The present invention relates to an archery bow accessory that can be removably mounted to the riser of an archery bow. The accessories of the invention can be used to change the color, camo pattern, and/or shape of an archery bow riser to conceal and blend same in to different environments and/or to change the appearance of the archery bow to a color or fashion preference of the archer.

13 Claims, 6 Drawing Sheets

ARCHERY BOW CONCEALMENT ACCESSORY

FIELD OF THE INVENTION

The present invention relates to an accessory that can be used to customize the look, appearance and performance of an archery bow.

BACKGROUND OF THE INVENTION

Archery hunting with compound bows has become extremely popular. Bows are becoming more and more expensive each year but offer no way to customize the look or appearance of the riser. When a consumer purchases an archery bow they are forced to choose a specific camouflage pattern, color, look and/or design. Hunters travel to different areas and hunt for different animals often. When this is done a hunter more often than not will change the type of camouflage clothing used to match the environment of the game he is after but cannot do so with his or her bow. To change the look of a bow you are stuck with either repainting your bow or buying a completely new model which can be very expensive.

The claimed invention obviates the deficiencies of the prior art and provides an inexpensive and convenient method to change the appearance of the riser of an archery bow to match the environment of the hunt and/or to change the color and/or appearance of the bow to the preference of the user.

SUMMARY OF THE INVENTION

The claimed invention relates to an archery bow accessory that can be removably mounted to the riser of an archery bow. The accessories of the invention can be used to change the color, camo pattern, and/or shape of an archery bow riser to conceal and blend same in to different environments and/or to change the appearance of the archery bow to a color or fashion preference of the archer.

DETAILED DESCRIPTION OF THE FIGURES

The drawings illustrate the best mode currently contemplated as practicing the present invention.

DETAILED DESCRIPTION OF THE INVENTION

Figure 1:
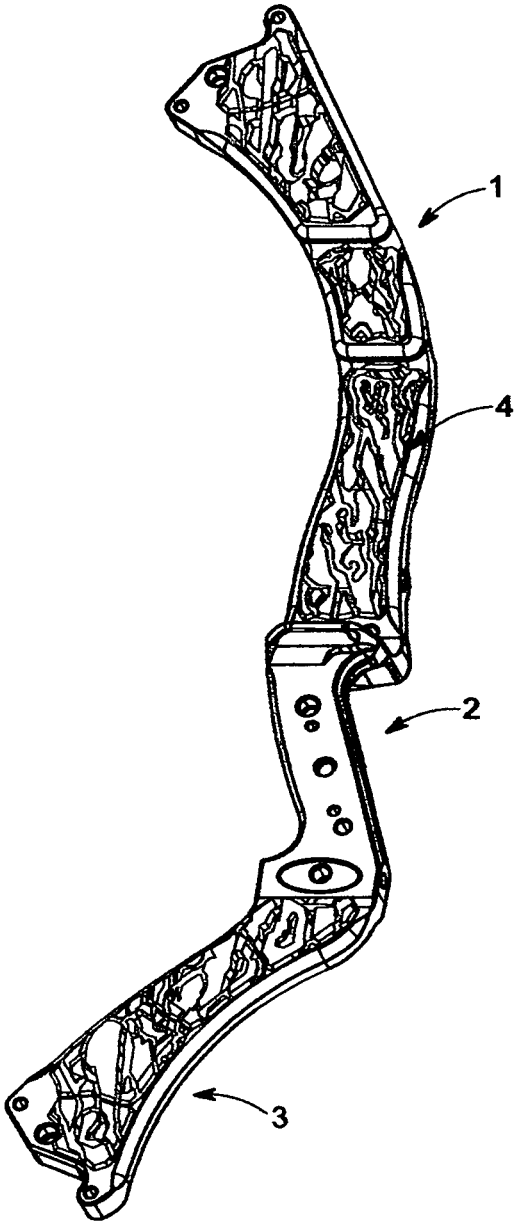
FIG. 1 is a side plan view of a bow riser containing the grommet inserts of the invention.

Archery bows are becoming more and more expensive each year, with some models easily exceeding $1000. These bows are typically chosen with a particular color and/or camo pattern permanently affixed to the riser and/or limbs and there is no cost-effective method to customize the look or appearance of the archery bow, and in particular the archery bow riser. Hunters travel to different areas and hunt for different animals often. If one purchases a bow having a camo pattern to match a desert environment and subsequently books a hunt to a snow-covered region, one must either hunt in snow with a bow having a desert pattern, paint the riser of the bow, or purchase an entirely new bow with snow camo. The first option is undesirable and the latter two are expensive and/or impractical. The accessory of the invention allows one to easily, quickly and cheaply change the color, camo pattern, shape and/or appearance of the archery bow riser to conceal and blend same to match the particular environment that the hunter is hunting in. Alternatively, the accessory of the invention can be utilized to change the color and/or the appearance of the archery bow to the color or fashion preference of the user.

The bow concealment accessory of the invention can be removably mounted to the riser of an archery bow through various means, including screws, one or more molded bushings or grommets that insert into the openings of a bow riser. More specifically, most archery bow risers contain a number or openings or apertures that extend completely through the riser. The accessories of the invention can be removably affixed or inserted into said riser through said openings or apertures through the use of one or more screws, bushings, grommets, inserts with cap screws or they can be fabricated to snap into place. In one embodiment the accessory of the invention comprises a grommet insert that is fitted to one or more apertures of the invention. In another embodiment, the accessory of the invention can be fabricated as an overlay fitted to match the dimensions of the upper and/or lower portions of the riser of a bow. The overlay can be fabricated such that it snaps into place or it can be affixed to the riser through one or more apertures of the riser through one or more bushings and/or grommets. As in the knowledge of one of ordinary skill in the art, other means for affixing the accessory of the invention can be utilized.

The accessories of the invention can be utilized to change the color, camo pattern, and/or shape of the bow riser in order to conceal and blend in to different types of environments such as rocky terrain, desert, snowy environment, green woods, etc. The accessory of the invention can also be utilized by the user to change the color and/or appearance of the bow to the liking of the user. The individual bushings can also be made of a material that acts as vibration dampener and provide uniform distribution of vibration throughout the entire riser.

Additionally, in order to attempt to make an individual as camouflaged as possible when hunting, prior art bow risers have been painted with various patterns in order to give the bow riser a more natural appearance to make visual detection of the bow and individual by an animal more difficult. These patterns are painted directly on the flat surfaces of the bow riser in order to break up the visible outline of the bow riser. However, because the coatings are painted on the flat surfaces of the riser, the general outline for the bow riser is still present, and, because of the materials used to form the riser, the surfaces also reflect light that strikes the flat surfaces, thus preventing the bow riser from being fully camouflaged by the painted patterns on the risers. In order to overcome this deficiency, the accessory of the invention can be formed to optionally provide an enhanced gripping surface on the bow riser, formed with a gripping additive and/or by forming said accessory with a number of irregularly spaced, outwardly extending portions, and irregularly spaced, inwardly extending portions. These portions create a high-friction surface that can be grasped by an individual utilizing the riser. In addition, the irregular outer surface provides a three-dimensional camouflage pattern on the exterior of the riser. This three-dimensional pattern creates shadowed sections on the riser which change depending upon the angle at which light strikes, thereby minimizing light reflectance and providing a more natural and enhanced camouflaged appearance.

In one embodiment the accessory of the invention comprises a three-dimensional pattern. In another embodiment the three-dimensional pattern is a tree bark type pattern. In another embodiment, the bushing attachment means and/or the archery accessory of the invention has vibration and/or noise dampening properties.

The accessory of the invention can be made of virtually any material including plastic, carbon fiber, rubber, urethane type materials and the like. In one embodiment the accessory of the invention is made of a sound dampening and/or vibration adsorbing material. Such materials are typically warmer to the touch than painted metal surface, which provides an additional benefit to the user. Nonlimiting examples of materials usefully employed in the context of the invention include, but are not limited to, elastomeric materials. "Elastomer" and "elastomeric" are words of art. Elastomers are polymeric materials which can be rapidly stretched to their elastic limit (typically 200-1000 or more percent) and which snap or rebound to their original shape and dimensions when the "stretching" force is removed. Elastomers are thus defined in terms of their physical properties. Elastomeric is the adjective counterpart of, and has essentially the same meaning as, elastomer. The selected elastomeric material may or may not be viscoelastic. If it is, the response of the material to the imposed load arising from shock and vibration will have both viscous and elastic qualifiers.

Specific examples of materials useful in the context of the invention include, but are not limited to, elastomeric materials and/or polymers including, but not limited to rubber, elastomeric rubbers, elastic and/or vinyl (co)polymers, rubber copolymers, polyurethane, e.g., Sorbothane™ (Sorbothane Inc., Kent, Ohio), Navcom™ (Allsop/Sims Vibration, Bellingham, Wash.), Line-X™ (Line-X Protective Coatings), or Tuff Stuff® (Rhino Linings and Coatings, Tualatin, Oreg.), viscoelastic rubber such as Smactane®, Smacsonic® (SMAC, Branly, France), polyurea coatings such as Duracoat™ (DuraCoat America), styrene-butadiene-styrene-, styrene-ethylene/butylene-styrene, styrene-ethylene/propylene-styrene, styrene-isoprenestyrene, polyisoprene, ethylene-propylene diene rubbers (EPDM), chlorinated rubbers, nitrile rubbers, methylmethacrylate styrene-butadiene block copolymers, polybutadiene, acrylonitrile-butadiene-styrene copolymers, rubber acrylic (co)polymers and so forth, just to mention a few. Any of these materials can be optionally crosslinked, if necessary, to meet the performance and durability standards of the present invention. The accessories of the invention provide significant sound dampening properties to the archery bow in part due to the large surface area of the riser that is covered.

Additionally, certain thermosetting polymeric materials can also be usefully employed to make the accessories of the invention. Examples of such materials include, but are not limited to unsaturated polyesters, epoxy resins, vinyl ester resins, phenolic resins, polyether, polyester and polyurea urethanes, urethane-acrylic composites and/or materials, and the like. Such materials can advantageously be crosslinked with styrene, amines, vinyl toluene, hexamethylenetetramine, and the like.

Additionally, the accessory of the invention can contain uv suppressing and/or adsorbing materials or pigments useful in rendering the archery bow invisible or nearly invisible to deer and other animals able to discern objects in this light spectrum.

With regard to the drawing figures in which like reference numerals designate like parts throughout the disclosure, a bow riser constructed according to the present invention is indicated generally in FIG. 1. The bow riser 1 is adapted to be secured to a pair of curved bow ends (not shown) between which can be strung a bowstring (not shown) in order to form a complete bow (not shown) in any known manner. The bow riser defines an upper portion 1, a central portion 2, and a lower portion 3, which can be formed from any suitably rigid and lightweight material such as a metal, carbon fiber, or hard plastic. The upper portion and lower portion extend from opposite sides of the central portion 2, which is formed to be narrower than the upper portion and lower portion to define a handgrip for an individual to hold the riser 1, and bow, when in use. The riser of FIG. 1 is fitted with the accessories of the invention Various other well-known functional members can also be secured to the various portions of the riser 1 as needed or desired, such as a sight (not shown), counterweight (not shown), or arrow rest (not shown), among others.

Figure 2:
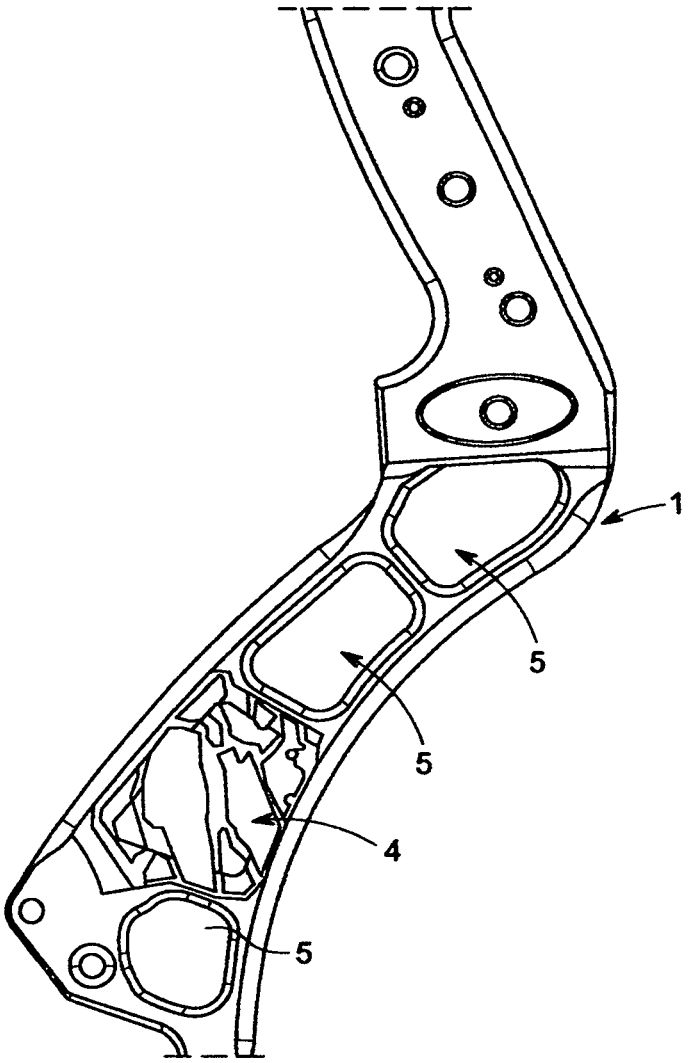
FIG. 2 is a side plan view of the lower portion of an archery bow riser with a grommet insert of the invention.

Referring to FIG. 2, each portion of the riser 1 also includes a number of apertures 4 of various sizes formed therein that each has an irregular periphery. The irregular periphery for each aperture 5 breaks up the visible outline or silhouette of the bow riser 1 in order to provide a more camouflaged appearance to the bow riser 1. Further, each of the apertures 5 preferably has periphery with a different shape in order to provide a further varied appearance to the bow riser 1. Also, the periphery of each aperture 5 is preferably formed without any sharp corners having less than a ¼ inch radius of curvature, to provide an even more natural camouflaged appearance to the riser 1. FIG. 2 also shows placement of one of the grommet inserts of the invention 4.

Figure 3:
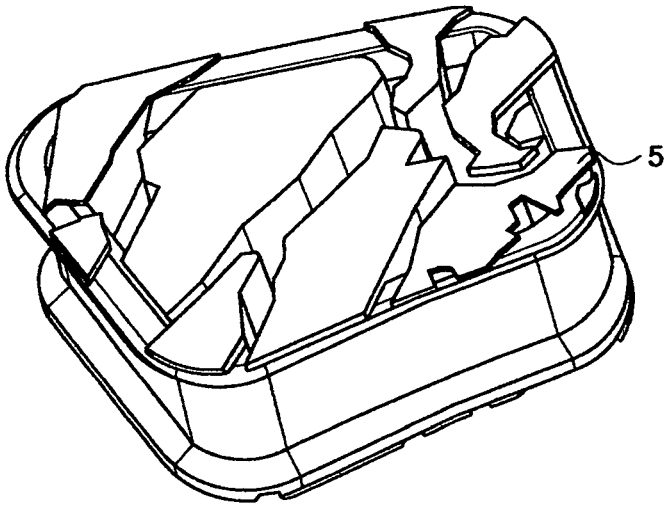
FIG. 3 is a blown-up view of a grommet insert of the invention.
Figure 4:
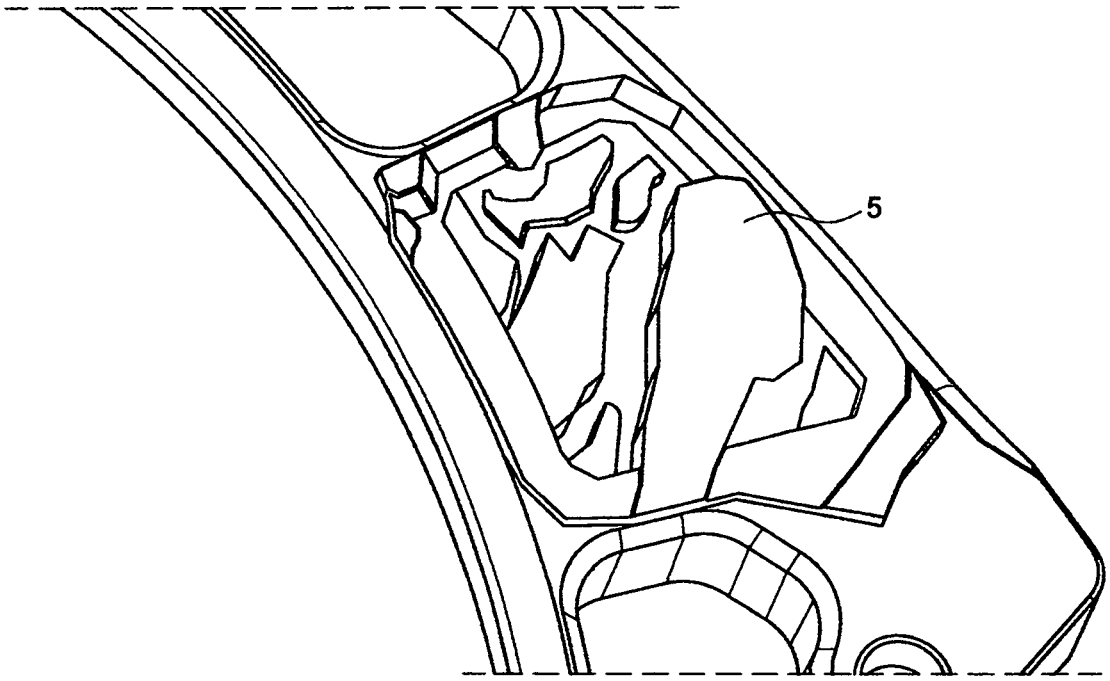
FIG. 4 is a blown-up view of the grommet insert of the invention when places in the bow riser.

FIG. 3 shows an individual grommet 4 of the invention which can be fitted to each individual aperture of the riser. FIG. 4 shows the grommet insert of the invention seated in the aperture of a bow riser.

Figure 5:
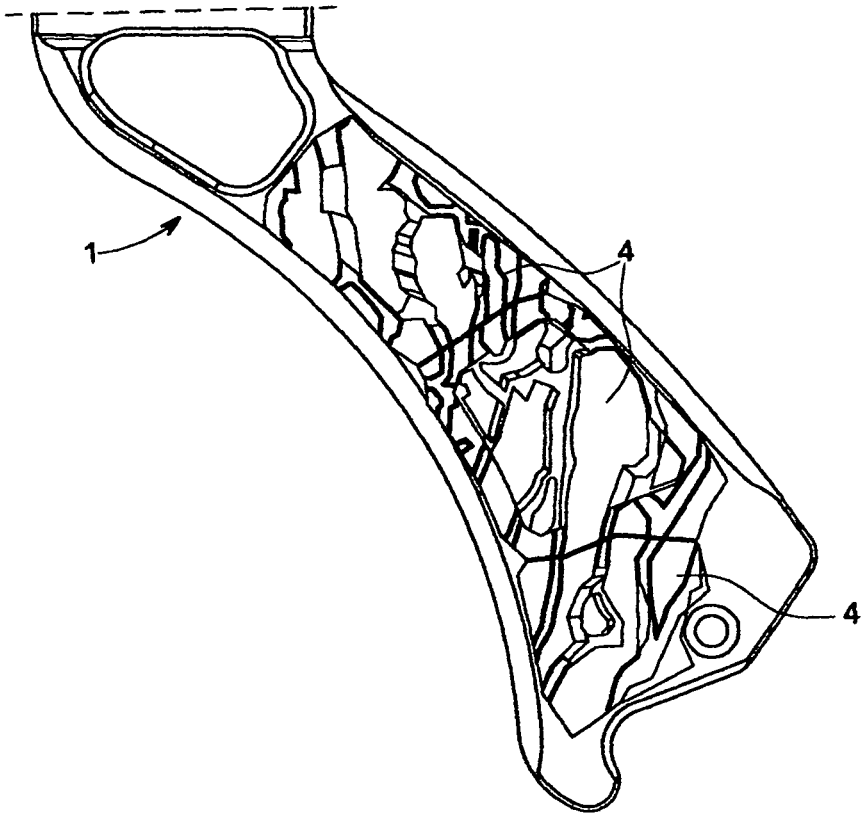
FIGS. 5-6 depict the grommets of the invention inserted in the upper and lower portions of the archery bow riser.
Figure 6:
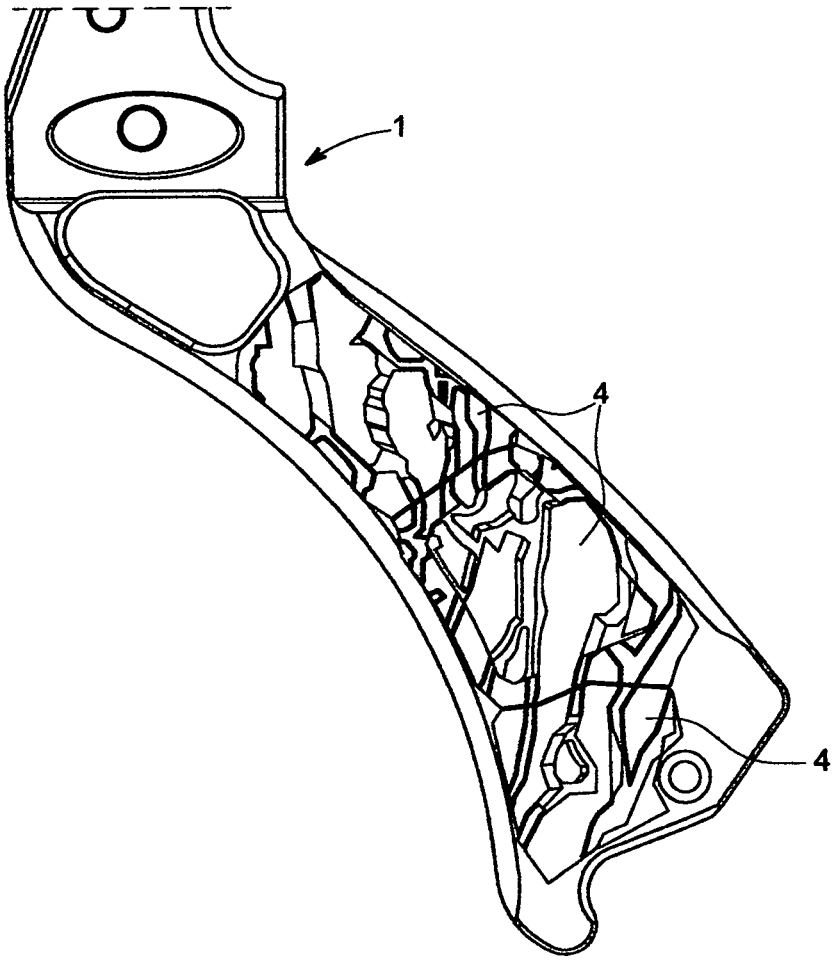

Referring now to FIGS. 5-6, the look and appearance of the upper portion and lower portion of the bow riser 1, can be modified through use of the grommet inserts of the invention 4. As shown by the figures, the accessory of the invention can take the form of individual grommet inserts that are affixed to one or more apertures of the riser, thereby modifying the look and/or appearance of same. Alternatively, instead of individual grommets, the accessory of the invention can comprise a single larger piece fitted to cover more surface area of the riser. This larger accessory would be similarly affixed to the riser through one or more riser apertures. As mentioned earlier, the accessory of the invention can be made of virtually any material that is suitably resilient, such as a silicon, rubber, or polyurethane type material. The accessory of the invention can optionally also provide a sound-dampening capacity to the riser 1.

Different archery bow manufacturers have different riser designs and 3-dimensional riser cutout patterns. The accessory of the invention can be sized to fit any riser and any riser cutout design pattern. The accessory can be smooth, or in another embodiment can be of three-dimensional design. In one embodiment, the outer surface of the accessory is fabricated with a three-dimensional pattern, for example a bark pattern, as three-dimensional accessories can provide a greater camouflage and/or sound dampening effect.

Finally, the invention is not limited in its application to archery bows. The principles of the invention can be equally useful in modifying the appearance of other archery accessories such as sights, arrow rests, trigger releases, bow pulleys and cams, arrows, quivers, broadheads and the like.

Additionally, many treestands have platforms and/or seats that have grate-like openings. The accessory of the claimed invention can be adapted to be affixed to the platform of most treestand platforms and seats providing additional concealment characteristics and sound dampening qualities.

Various other embodiments of the present invention are considered within the scope of the following claims particularly point out and distinctly claiming the subject matter regarded as the invention.

I claim:

1. An archery accessory for modifying the look and appearance of an archery bow, wherein said accessory is one piece and comprises a three-dimensional tree bark pattern said accessory consisting of a sound and/or vibration dampening material, wherein said archery bow comprises a riser having one or more openings or apertures, and wherein said accessory is configured to be removably affixed to the riser through one or more of said apertures of said riser, and wherein said accessory is adapted to change the color, shape and/or appearance of the archery bow riser.

2. The accessory of claim 1 which is fitted to one or more apertures of said riser.

3. The accessory of claim 1 wherein said accessory comprises a camouflage pattern and/or color that is desirable to the user.

4. The accessory of claim 1 which is removably affixed to said riser through said openings or apertures of said riser through the use of one or more screws, bushings, grommets, inserts with cap screws or they can be fabricated to snap into place.

5. The accessory of claim 1 which comprises a grommet insert.

6. An archery bow riser comprising the accessory of claim 1.

7. The archery accessory of claim 1 wherein said accessory comprises a UV suppressing or adsorbing material.

8. An archery riser skin or overlay for changing the appearance of an archery bow, wherein said skin is made of a sound and/or vibration dampening material having sound and/or vibration dampening qualities, said skin fitted to match the shape of said riser which comprises an upper portion and a lower portion, wherein said skin is configured to be removably affixed to the upper and/or lower portion of said riser, wherein said skin is removably affixed to said riser, wherein said riser comprises openings or apertures, said riser skin affixed to said riser through said openings or apertures through the use of one or more screws, bushings, grommets, inserts with cap screws or they can be fabricated to snap into place.

9. The skin of claim 8 wherein said skin has a three-dimensional pattern.

10. The skin of claim 9 wherein said three-dimensional pattern is a tree bark pattern.

11. The riser skin of claim 8 which comprises a camouflage pattern and/or color that is desirable to the user.

12. An archery bow riser comprising the riser skin of claim 8.

13. The archery riser skin of claim 8 wherein said riser skin comprises a UV suppressing or adsorbing material.

* * * * *